US011250793B1

(12) United States Patent
Chen et al.

(10) Patent No.: US 11,250,793 B1
(45) Date of Patent: Feb. 15, 2022

(54) DRIVING METHOD AND DRIVER CHIP FOR DISPLAY PANEL, AND DISPLAY DEVICE

(71) Applicants: Chongqing HKC Optoelectronics Technology Co., Ltd., Chongqing (CN); HKC Corporation Limited, Shenzhen (CN)

(72) Inventors: Wei Chen, Chongqing (CN); Wei Li, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/243,609

(22) Filed: Apr. 29, 2021

(30) Foreign Application Priority Data

Jul. 30, 2020 (CN) ..... 202010748908.6

(51) Int. Cl.
*G09G 3/34* (2006.01)
*G09G 3/36* (2006.01)
*G09G 3/20* (2006.01)

(52) U.S. Cl.
CPC ..... *G09G 3/342* (2013.01); *G09G 3/2007* (2013.01); *G09G 3/3685* (2013.01); *G09G 2320/0233* (2013.01); *G09G 2320/0626* (2013.01)

(58) Field of Classification Search
None
See application file for complete search history.

(56) References Cited

U.S. PATENT DOCUMENTS 10,163,423 B2 * 12/2018 Chen ..... G09G 5/10
2006/0256240 A1 * 11/2006 Oka ..... H04N 5/20 348/630
2008/0252666 A1 * 10/2008 Chen ..... G09G 3/2044 345/690
2008/0278432 A1 * 11/2008 Ohshima ..... G09G 3/3611 345/102
2009/0267876 A1 * 10/2009 Kerofsky ..... G09G 3/2007 345/87
2009/0284457 A1 * 11/2009 Botzas ..... G09G 3/3406 345/102
2011/0122057 A1 * 5/2011 Kim ..... G09G 3/3426 345/102
2015/0070376 A1 * 3/2015 Fujine ..... G09G 3/36 345/589
2018/0047345 A1 * 2/2018 Dunn ..... G02F 1/133603
2018/0233109 A1 * 8/2018 Lin ..... G09G 3/342
2020/0133068 A1 * 4/2020 Lu ..... G02B 6/0083
2020/0160810 A1 * 5/2020 Lai ..... G09G 3/3413
2021/0097943 A1 * 4/2021 Wyatt ..... H01L 27/3216

* cited by examiner

*Primary Examiner* — Matthew Yeung

(57) ABSTRACT

The present application discloses a driving method and a driver chip for a display panel, and a display device, where the driving method includes steps of: acquiring a refresh rate of a first data information; performing local dimming on the first data information to generate a first backlight driving information and a first data driving information; and adjusting the first backlight driving information and the first data driving information according to the refresh rate to generate a second backlight driving information and a second data driving information, respectively.

19 Claims, 5 Drawing Sheets

DRIVING METHOD AND DRIVER CHIP FOR DISPLAY PANEL, AND DISPLAY DEVICE

The present application claims priority to the Chinese Patent Application No. 202010748908.6, filed Jul. 30, 2020, which is hereby incorporated by reference herein as if set forth in its entirety.

TECHNICAL FIELD

The present application relates to the field of display technologies, particularly to a driving method and a driver chip for a display panel, and a display device.

BACKGROUND

The statements herein merely provide background information related to the present application and do not necessarily constitute the conventional art.

With the increasing popularity of liquid crystal display panels, the application range of the liquid crystal display panels is also becoming varied, from early computers, electronic clocks and radios to notebook computers, desktop computers, televisions, and the like. In order to reduce power consumption and improve contrast ratio, an area of backlight of a corresponding part in a display panel is usually adjusted by making the backlight darker, namely performing local dimming. The local dimming technology is a technology for analyzing data content of a part of display area of a display panel according to picture grayscale information based on inputted information source data and dynamically adjusting backlight of the corresponding display area.

Since the refresh rate of the information source data itself may be different due to different formats, such as 50 HZ or 60 HZ, different display panels are produced with a preset corresponding refresh rate, i.e. a standard refresh rate. However, the display panel is provided with a local dimming function only for data information with a fixed refresh rate, such as 60 HZ, and if the refresh rate of the inputted data signal is different from the refresh rate corresponding to the local dimming, the brightness of the panel is inconsistent, which results in bad visual experience of customers.

SUMMARY

The present application aims to provide a driving method and a driver chip for a display panel and a display device which improve brightness change and reduce trailing smear.

The present application discloses a driving method for a display panel, which includes steps of:

acquiring a refresh rate of a first data information inputted from the display panel, performing local dimming on the first data information to generate a first backlight driving information and a first data driving information; and adjusting the first backlight driving information and the first data driving information according to the refresh rate of the first data information to correspondingly generate a second backlight driving information to a backlight driving circuit of the display panel, and further generate a second data driving information to a data driving circuit of the display panel;

where the greater the refresh rate of the first data information is, the darker a backlight of the backlight driving circuit is made by the second backlight driving information, and further the greater the refresh rate of the first data information is, the greater a grayscale value of the data driving circuit is made by the second data driving information; the smaller the refresh rate is, the brighter the backlight of the backlight driving circuit is made by the second backlight driving information, and further the smaller the refresh rate is, the smaller the grayscale value of the data driving circuit is made by the second data driving information.

Optionally, the step of adjusting the first backlight driving information and the first data driving information according to the refresh rate to correspondingly generate a second backlight driving information to a backlight driving circuit of the display panel and further generate a second data driving information to a data driving circuit of the display panel includes:

finding a gain value of the refresh rate of the first data information through a preset dynamic local dimming backlight gain table; and counting the gain value and the first backlight driving information to generate the second backlight driving information, and then outputting the second backlight driving information to the backlight driving circuit.

Optionally, the step of adjusting the first backlight driving information and the first data driving information according to the refresh rate to correspondingly generate a second backlight driving information to a backlight driving circuit of the display panel and further generate a second data driving information to a data driving circuit of the display panel includes:

finding a gain value of the refresh rate of the first data information through a preset dynamic local dimming data gain table; and outputting the second data driving information with a gain acquired by calculating according to the first data information and the gain value to the data driving circuit.

Optionally, the step of adjusting the first backlight driving information and the first data driving information according to the refresh rate to correspondingly generate a second backlight driving information to a backlight driving circuit of the display panel and further generate a second data driving information to a data driving circuit of the display panel includes:

finding a gain value of the refresh rate of the first data information through a preset dynamic local dimming gain table; and outputting the second backlight driving information with a gain acquired by multiplying the first backlight driving information by the gain value to the backlight driving circuit, and outputting the second data driving information with a gain acquired by dividing the first data driving information by the gain value to the data driving circuit.

Optionally, the preset dynamic local dimming gain table includes a plurality of refresh rates of the first data information and gain values corresponding to the plurality of refresh rates of the first data information in a one-to-one manner; the greater the refresh rate is, the smaller the corresponding gain value is; when the refresh rate is smaller than a standard refresh rate of a current display panel, the corresponding preset gain value is greater than or equal to 1, and when the refresh rate is greater than the standard refresh rate of the current display panel, the corresponding preset gain value is smaller than or equal to 1.

Optionally, in the step of acquiring a refresh rate of a first data information inputted from the display panel, performing local dimming on the first data information to generate a first backlight driving information and a first data driving information, the refresh rate of the first data information is acquired by storing and calculating the number of pictures of the first data information inputted in one second.

Optionally, before the step of acquiring a refresh rate of a first data information inputted from the display panel, performing local dimming on the first data information to generate a first backlight driving information and a first data driving information, further included are steps of:

receiving information source data; and calculating and determining whether a picture of the information source data is a static picture or a dynamic picture, adjusting the refresh rate of the information source data, and generating the first data information with a lower refresh rate if the received picture is the static picture, and generating the first data information with a higher refresh rate if the received picture is the dynamic picture.

The present application also discloses a driver chip for a display panel, which includes a local dimming circuit, a refresh rate gain adjusting circuit, a backlight driving circuit and a data driving circuit. The local dimming circuit receives a first data information inputted by the display panel, performs local dimming and outputs a first backlight driving information and a first data driving information; the refresh rate gain adjusting circuit receives the first data information inputted by the display panel, acquires the refresh rate of the first data information, adjusts the first backlight driving information according to the refresh rate, and forms and outputs a second backlight driving information, and in addition, the refresh rate gain adjusting circuit adjusts the first data driving information according to the refresh rate, and forms and outputs a second data driving information; the backlight driving circuit is connected to the refresh rate gain adjusting circuit, receives the second backlight driving information and drives the backlight module of the display panel to display; the data driving circuit is connected to the refresh rate gain adjusting circuit, receives the second data driving information and drives the display panel to display;

where the greater the refresh rate of the first data information is, the darker a backlight of the backlight driving circuit is made by the second backlight driving information, and further the greater the refresh rate of the first data information is, the greater a grayscale value of the data driving circuit is made by the second data driving information; the smaller the refresh rate is, the brighter the backlight of the backlight driving circuit is made by the second backlight driving information, and further the smaller the refresh rate is, the smaller the grayscale value of the data driving circuit is made by the second data driving information.

Optionally, the refresh rate gain adjusting circuit includes a refresh rate gain value generating circuit and a gain calculating circuit. The refresh rate gain value generating circuit stores therein a dynamic local dimming gain table; the gain calculating circuit includes a multiplication calculator and a division calculator; the refresh rate gain value generating circuit stores therein a preset dynamic local dimming gain table including a plurality of refresh rates of the first data information and gain values corresponding to the plurality of refresh rates of the first data information in a one to one manner, where the refresh rate gain value generating circuit finds a gain value of the refresh rate of the first data information through the preset dynamic local dimming gain table, and the multiplication calculator multiplies the first backlight driving information by the gain value to acquire the second backlight driving information with a gain and outputs the second backlight driving information to the backlight driving circuit, and the division calculator divides the first data driving information by the gain value to acquire the second data driving information with a gain and outputs the second data driving information to the data driving circuit.

The present application also discloses a display device, which includes a display panel, a backlight module and the driver chip as described above, where the driver chip drives the backlight module and the display panel for image display.

Compared with the solution in which local dimming is provided only for data information with a fixed refresh rate (such as 60 HZ), in the present application, after the data information is subjected to local dimming to generate driving information for local dimming, the driving information having undergone the local dimming is adjusted according to the refresh rate of the data information; if the refresh rate is greater, the backlight driving information is correspondingly adjusted to make the backlight of the backlight driving circuit darker, and meanwhile, the data driving information is adjusted to make the grayscale value of the data driving circuit greater; if the refresh rate is smaller, the backlight driving information is correspondingly adjusted to make the backlight of the backlight driving circuit brighter, and meanwhile, the data driving information is adjusted to make the grayscale value of the data driving circuit smaller. By correspondingly adjusting different backlight and picture data at different refresh rates, the corresponding grayscale value of the picture data is correspondingly adjusted while the backlight is adjusted, and the influence on the visual experience of customers caused by the brightness change of the display panel due to the fact that the value after local dimming is not optimal is also prevented.

BRIEF DESCRIPTION OF DRAWINGS

The accompanying drawings, which are included to provide a further understanding of embodiments of the present application and constitute a part of the specification, illustrate embodiments of the application and, together with the text description, explain the principles of the application. Obviously, the drawings in the following description are merely some embodiments of the present application, and those skilled in the art can obtain other drawings according to the drawings without any inventive labor. In the drawings.

In these figures, 100 represents display device; 200 represents display panel; 300 represents driver chip; 310 represents local dimming circuit; 320 represents refresh rate gain adjusting circuit; 330 represents backlight driving circuit; 340 represents data driving circuit; 350 represents refresh rate gain value generating circuit; 360 represents dynamic local dimming gain table; 370 represents gain calculating circuit; 380 represents multiplication calculator; 390 represents division calculator; 400 represents backlight module; 410 represents refresh rate adjusting circuit.

DETAILED DESCRIPTION OF EMBODIMENTS

It should be understood that the terminology, specific structural and functional details disclosed are merely exemplary for the purpose of describing specific embodiments. However, the present application may be embodied in many alternative forms and should not be construed as being limited to the embodiments set forth herein.

In the description of the present application, the terms "first" and "second" are only for the purpose of description and cannot be construed to indicate relative importance or imply an indication of the number of technical features indicated. Therefore, unless otherwise stated, a feature defined as "first" and "second" may explicitly or implicitly include one or more of the features; "multiple" means two or more. The term "include" and any variations thereof are intended to be inclusive in a non-closed manner, that is, the presence or addition of one or more other features, integers, steps, operations, units, components and/or combinations thereof may be possible.

In addition, the terms "center", "horizontally", "up", "down", "left", "right", "vertical", "horizontal", "top", "bottom", "inner", "outer" and the like for indicating an orientation or positional relationship are based on the description of the orientation or relative positional relationship shown in the accompanying drawings, and are only simplified description facilitating description of the application, and are not intended to indicate that the device or element referred to must have a particular orientation, be configured and operated in a particular orientation, and therefore cannot be construed as limiting the present application.

In addition, unless expressly specified and defined otherwise, the terms "mount", "attach" and "connect" are to be understood broadly. For example, it can be a fixed connection, a detachable connection, or an integral connection; it can be either a mechanical connection or an electrical connection; it can be a direct connection or an indirect connection through an intermediate medium, or an internal connection between two elements. For those skilled in the art, the specific meaning of the above terms in the present application can be understood according to the specific circumstances.

The present application will now be further described by reference to the accompanying drawings and optional embodiments.

Figure 1:
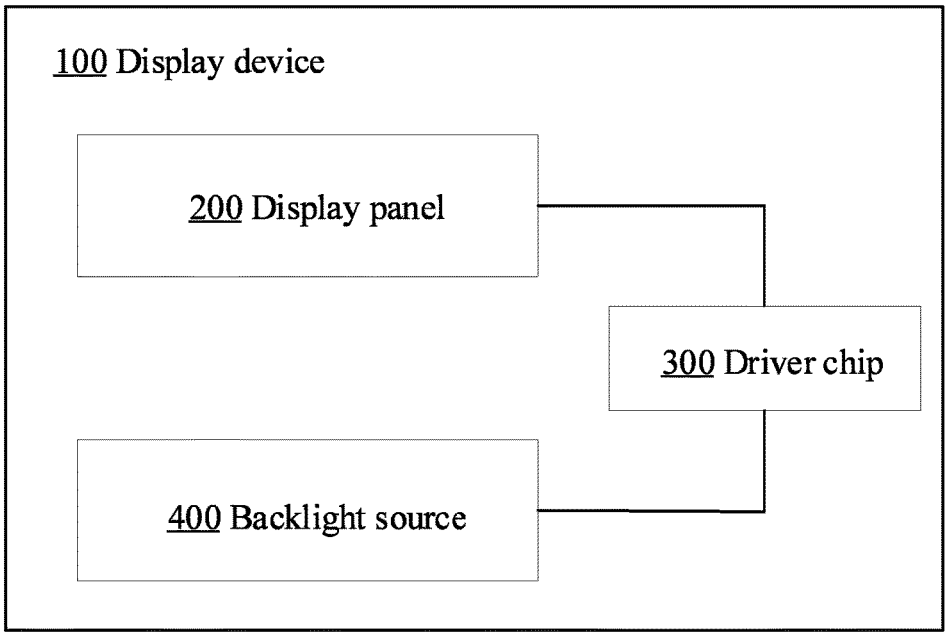
FIG. 1 is a schematic diagram of a display device according to an embodiment of the present application.

As shown in FIG. 1, an embodiment of the present application discloses a display device 100, where the display device 100 includes a display panel 200, a driver chip 300, and a backlight 400. The driver chip 300 is coupled to the display panel 200 and the backlight 400, the driver chip drives the backlight 400 to provide backlight for the display panel 200, and the driver chip 300 drives the display panel 200 for image display.

Figure 2:
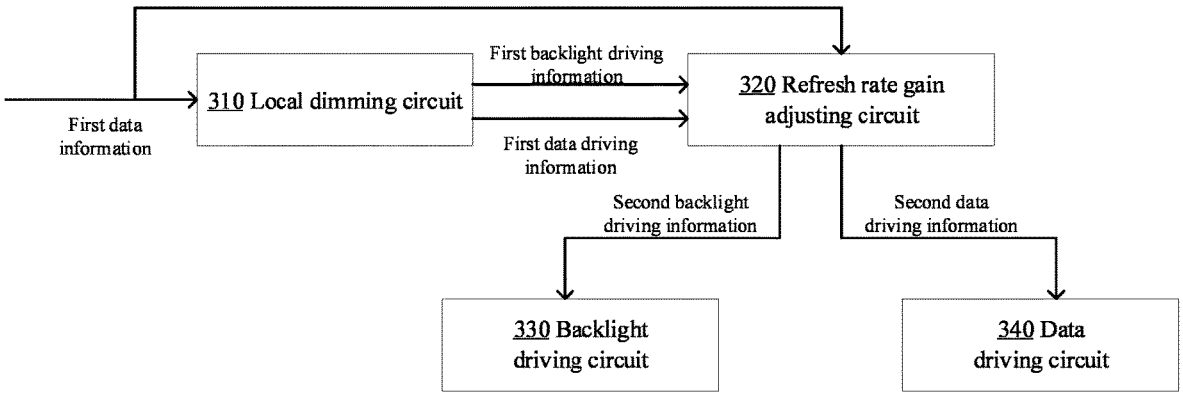
FIG. 2 is a schematic diagram of a driver chip (including data information change) according to an embodiment of the present application.
Figure 3:
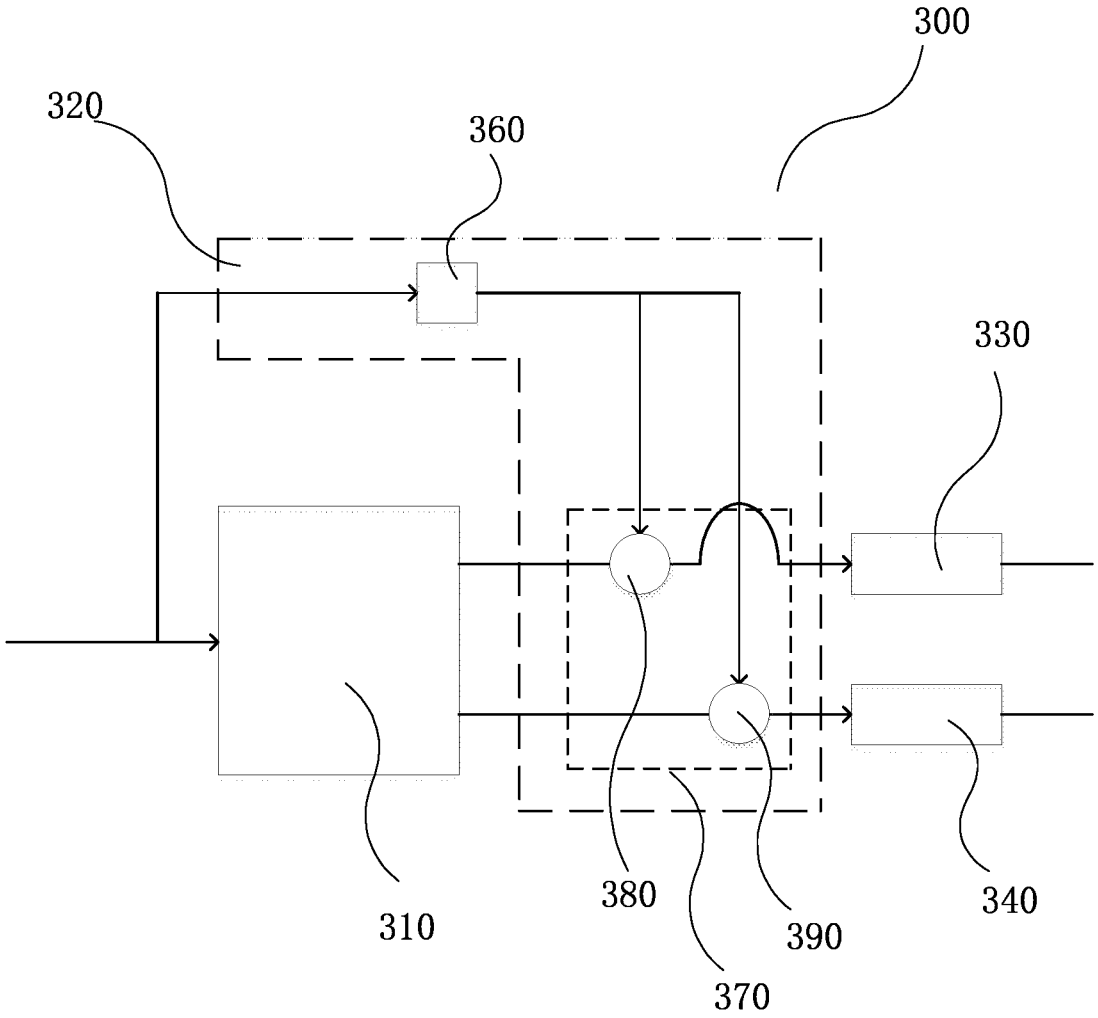
FIG. 3 is a schematic diagram of a driver chip according to an embodiment of the present application.

As shown in FIGS. 2 to 3, the driver chip 300 includes a local dimming circuit 310, a refresh rate gain adjusting circuit 320, a backlight driving circuit 330, and a data driving circuit 340. The local dimming circuit 310 receives inputted information source data or processed information source data as a first data information, analyzes data content of a block according to picture grayscale information of the inputted first data information, performs local dimming, and outputs a first backlight driving information and a first data driving information. Generally, if the grayscale of a certain area of an inputted information source data picture is darker, the backlight driving information of the corresponding area can be adjusted to make the backlight of the backlight driving circuit darker, and meanwhile, the data driving information of the corresponding area is adjusted to make the grayscale value of the data driving circuit greater; on the contrary, if the grayscale of a certain area of the inputted information source data picture is brighter, the backlight driving information of the corresponding area can be adjusted to make the backlight of the backlight driving circuit brighter, and meanwhile, as required, the data driving information of the corresponding area is adjusted so that the required brightness is displayed by the corresponding pixel.

The refresh rate gain adjusting circuit 320 receives the first data information, acquires the refresh rate of the first data information, adjusts the first backlight driving information according to the refresh rate, and forms and outputs a second backlight driving information. In addition, the refresh rate gain adjusting circuit adjusts the first data driving information according to the refresh rate, and forms and outputs a second data driving information. The backlight driving circuit 330 is connected to the refresh rate gain adjusting circuit 320, receives the second backlight driving information and drives the backlight module of the display panel to display; the data driving circuit 340 is connected to the refresh rate gain adjusting circuit 320, receives the second data driving information and drives the display panel to display, where it should be noted that the first data information is related picture data information driven to display by the display panel, and may be originally inputted information source data or processed information source data.

Due to the change of the refresh rate, the local dimming technology corresponds to the adjusted brightness and the change of the picture. As the refresh rate becomes greater, a second backlight driving information making the backlight of the backlight driving circuit 330 darker is correspondingly generated, and a second data driving information making the grayscale value of the data driving circuit 340 greater is correspondingly generated; on the contrary, as the refresh rate becomes smaller, a second backlight driving information making the backlight of the backlight driving circuit 330 brighter is correspondingly generated, and a second data driving information making the grayscale value of the data driving circuit 340 smaller is correspondingly generated. Thus, so that the picture brightness after local dimming corresponding to different refresh rates tends to be consistent. The backlight brightness is changed by changing the backlight driving information, and thus the backlight brightness is reduced. In addition, the voltage change corresponding to the grayscale value is controlled by changing the data driving information to prevent the situation of alternative brightness and darkness due to too large voltage difference on the data driving and the situation of brightness change of the display panel 200 caused by the fact that the value after local dimming is not optimal, all of which can affect the visual experience of customers.

Figure 4:
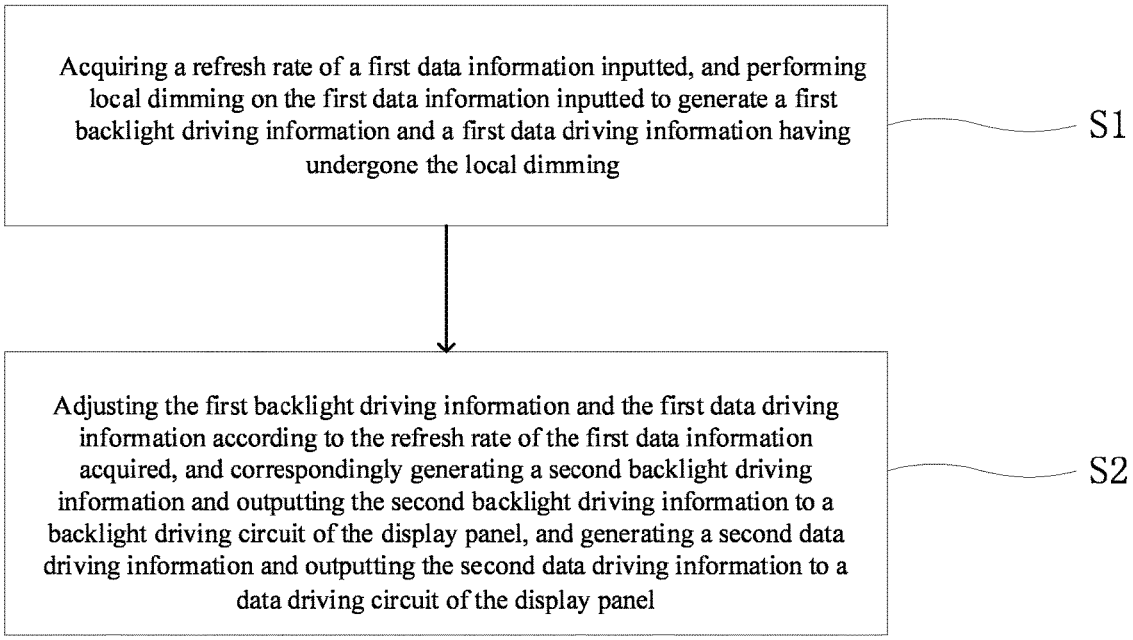
FIG. 4 is a flow chart of a driving method according to an embodiment of the present application.

Correspondingly, as shown in FIG. 4, the driving method for the display panel 200 includes steps of:

S1: acquiring a refresh rate of a first data information from the display panel, performing local dimming on the first data information to generate a first backlight driving information and a first data driving information; and

S2: adjusting the first backlight driving information and the first data driving information according to the refresh rate of the first data information to correspondingly generate a second backlight driving information to a backlight driving circuit of the display panel, and further generate a second data driving information to a data driving circuit of the display panel;

in step S1, in terms of the acquisition of refresh rate, the refresh rate of the first data information is acquired mainly by storing and calculating the number of pictures of the first data information inputted in one second. The greater the number of pictures of the first data information inputted in one second is, the greater the refresh rate of the first data information is, and thus the darker a backlight of the backlight driving circuit is made by the second backlight driving information, and the greater a grayscale value of the data driving circuit is made by the second data driving information. The brightness of the backlight becomes darker as the refresh rate of the first data information becomes greater, and the grayscale value increases synchronously with the increase the refresh rate of the first data information, which reduces power consumption and improves the contrast ratio of the display panel as well. The smaller the refresh rate is, the brighter the backlight of the backlight driving circuit is made by the second backlight driving information, and further the smaller the refresh rate is, the smaller the grayscale value of the data driving circuit is made by the second data driving information. When the refresh rate of the first data information becomes smaller, the backlight becomes brighter and the corresponding grayscale value becomes smaller, so that the definition of the picture is improved.

Further, the refresh rate gain adjusting circuit 320 includes a refresh rate gain value generating circuit 350 and a gain calculating circuit 370. The gain calculating circuit 370 is provided with a dynamic local dimming backlight gain table. When the backlight driving information is adjusted, a gain value of the refresh rate of the first data information is found through the dynamic local dimming backlight gain table, and a second backlight driving information with a gain is calculated according to the first backlight driving information and the gain value and then output to the backlight driving circuit. When the backlight driving information is adjusted, in addition to calculating by looking up a table, the calculation can be performed by other set programs or fitting a function, as long as the change can be realized for different refresh rates and thus the effect of the application is achieved.

For the display quality of the display panel, in addition to the corresponding adjustment of the backlight driving information, the corresponding adjustment of the data driving information is also required. Similarly, a dynamic local dimming data gain table may also be provided in the gain calculating circuit 370, and the specific calculation or adjustment may be performed by referring to the adjustment and calculation manner of the backlight driving information. However, it should be noted that in specific calculation, the two are different. For example, for a same gain value of a refresh rate, multiplication calculation is for backlight adjustment while division calculation is for data driving adjustment.

Through the above description, it is known that the actual output can be calculated using different tables or different functions to calculate the first backlight driving information and the first data driving information, respectively, so that the optimal setting of the dynamic local dimming corresponding to each frame rate can be satisfied. Needless to say, the adjustment of the data driving information and the adjustment of the backlight driving information may be organized into a table or a function, which is convenient, and may reduce the storage space of the refresh rate gain value generating circuit. The refresh rate gain value generating circuit 350 stores therein a dynamic local dimming gain table 360 which includes a plurality of refresh rates of the first data information and gain values corresponding to the plurality of refresh rates of the first data information in an one to one manner, and the refresh rate gain adjusting circuit 320 stores therein only the dynamic local dimming gain table 360, such as:

| Frame rate | Dynamic local dimming gain value |
|---|---|
| 50 HZ | 104% |
| 60 HZ | 100% |

The gain value for the calculation with the backlight driving information and the data driving information is mainly determined in the dynamic local dimming gain table 360 according to the refresh rate of the first data information, and further calculation is mainly completed through a gain calculating circuit 370, which includes a multiplication calculator 380 and a division calculator 390; the refresh rate gain value generating circuit 350 finds a gain value of the refresh rate of the first data information through the stored dynamic local dimming backlight gain table, and the multiplication calculator 380 multiplies the first backlight driving information by the gain value to acquire a second backlight driving information with a gain, and outputs the second backlight driving information to the backlight driving circuit 330, so as to reduce the backlight brightness, thereby reducing the backlight power consumption and saving more power; the division calculator 390 divides the first data driving information by the gain value to acquire a second data driving information with a gain, and outputs the second data driving information to the data driving circuit 340.

The above is an example of performing the dynamic local dimming gain adjustment on other refresh rates (e.g., 50 HZ) with 60 HZ as the standard refresh rate. It is needless to say that the dynamic local dimming gain adjustment on other refresh rates (e.g., 60 HZ, or even higher) may be performed if the standard refresh rate is set to 50 HZ.

In the driving display of the display panel, in terms of the refresh rate of the display panel 200, the display pixels in the display area are charged and discharged for each refresh. For a dynamic picture, higher refresh rate of related picture data information (i.e. the number of frames of a displayed picture in one second) driven to display by the display panel means faster picture switching speed and clearer displayed picture, as well as larger corresponding power consumption; while the lower the refresh rate is, the more likely the trailing smear will occur. For a static picture, whether the refresh rate is slightly higher or lower, the difference of the display effect is not obvious, and the power consumption can be effectively reduced by properly reducing the refresh rate.

It should be considered that, for a display panel with the refresh rate dynamically changing with the picture content, the display panel is provided with a local dimming function only for data information with a fixed refresh rate, such as 60 HZ or 50 HZ, and if the refresh rate of the inputted data signal is different from the refresh rate corresponding to the local dimming, the situation of alternative brightness and darkness will still occur. Therefore, our local dimming technique can provide dynamic adjustment in conjunction with dynamic changes of refresh rates.

Figure 5:
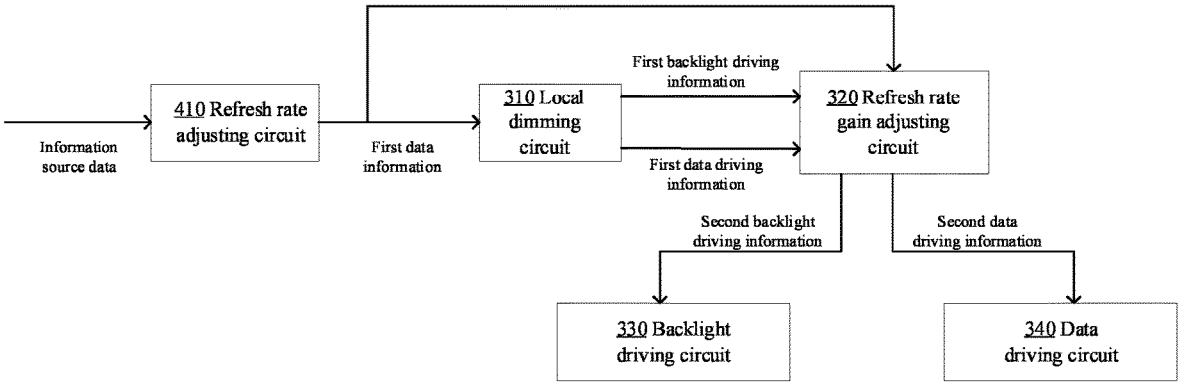
FIG. 5 is a schematic diagram of a driver chip (including data information change) according to another embodiment of the present application.
Figure 6:
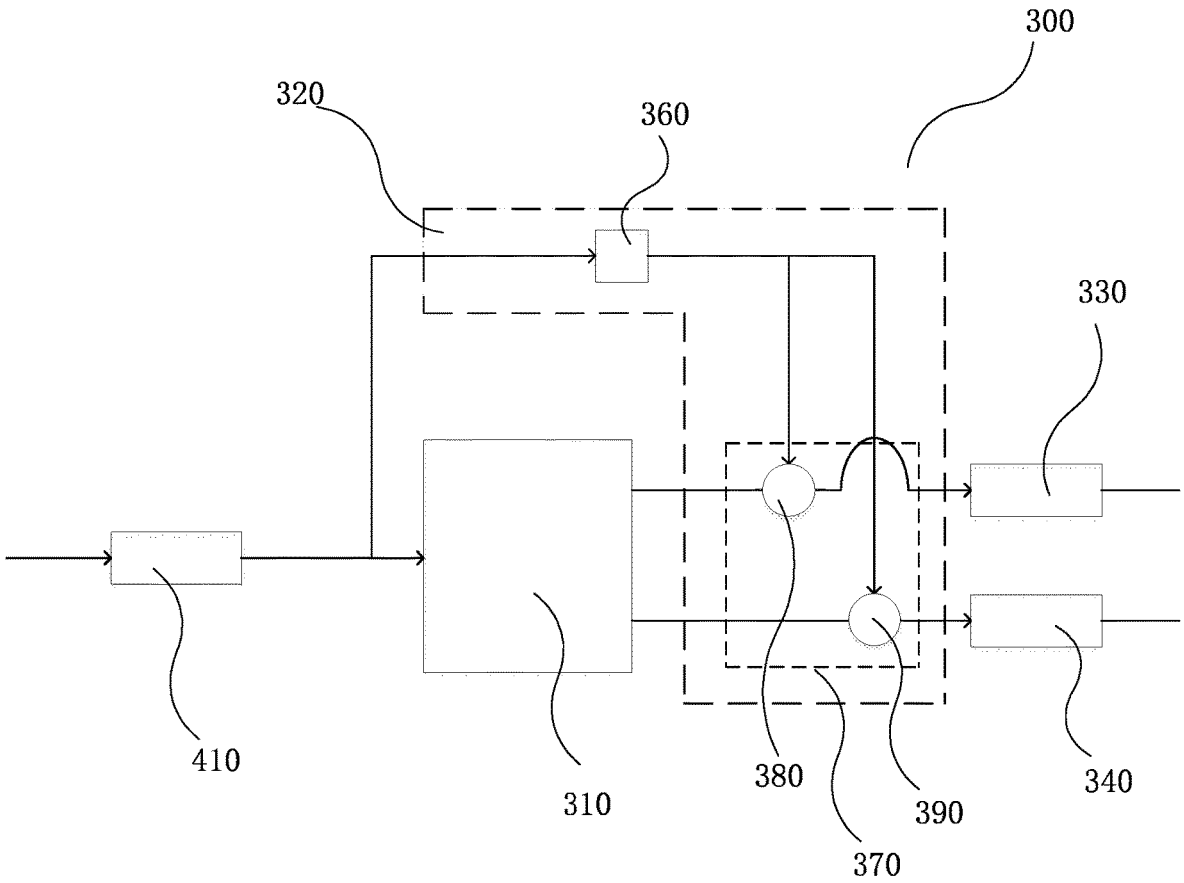
FIG. 6 is a schematic diagram of a driver chip according to another embodiment of the present application.
Figure 7:
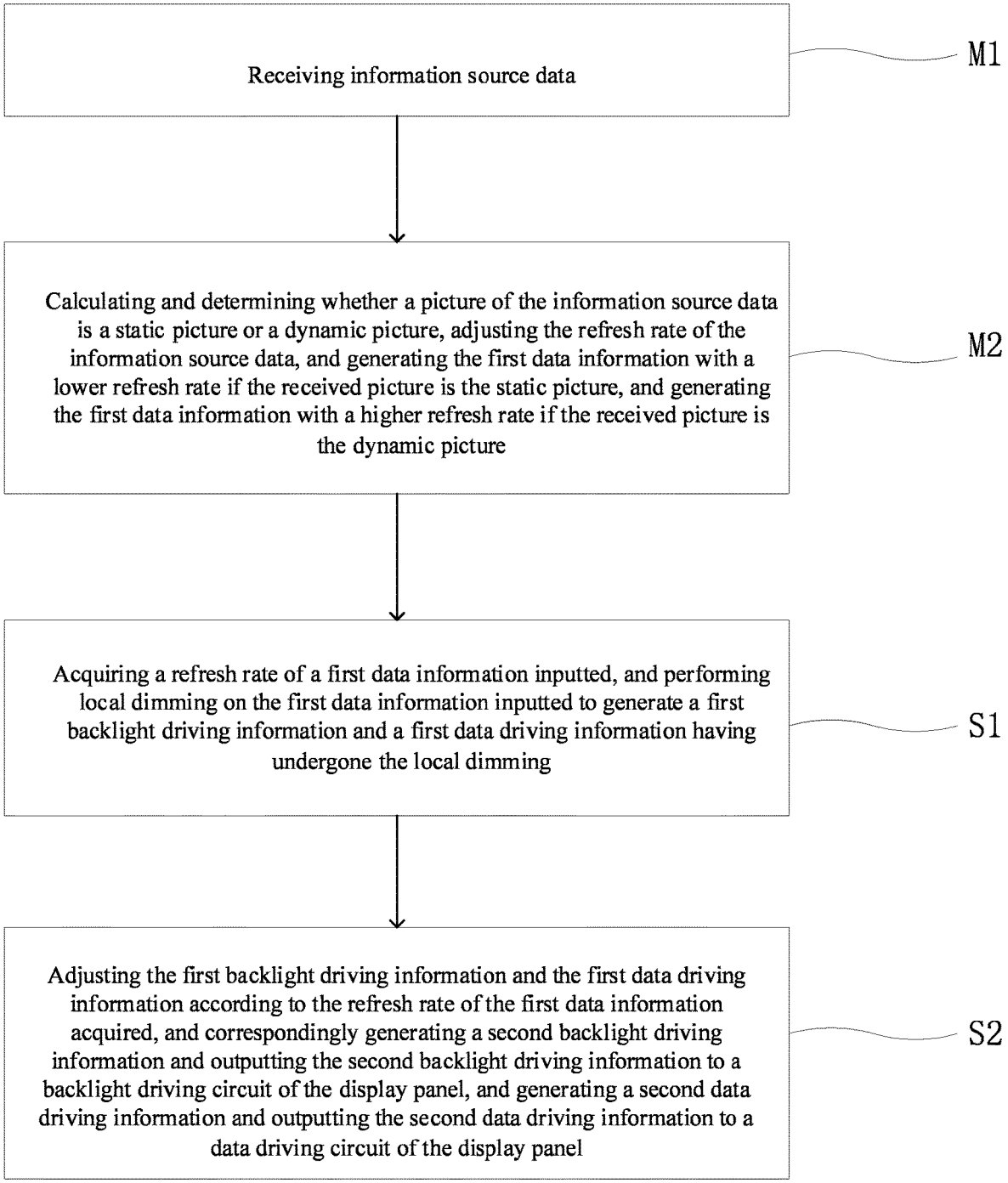
FIG. 7 is a flowchart of a driving method (including information source data) according to another embodiment of the present application.

As shown in FIGS. 5 to 7, as another embodiment of the present application, the display panel, different from the above embodiment, further includes a refresh rate adjusting circuit which is coupled to the refresh rate gain value generating circuit and the local dimming circuit, and the first data information is acquired by adjusting with a refresh rate adjusting circuit 410. Firstly, the refresh rate adjusting circuit 410 receives the information source data, and then the refresh rate adjusting circuit 410 calculates and determines whether a picture of the information source data is a static picture or a dynamic picture, and generates the first data information with a lower refresh rate if the received picture is the static picture, and generates the first data information with a higher refresh rate if the received picture is the dynamic picture. Such a design enables dynamic local dimming gain adjustment on the basis of the combination of dynamic refresh rate adjustment and local dimming technology, and a stable brightness and darkness can be well achieved.

Correspondingly, as shown in FIG. 7, before step S1, the method for driving a display panel described above further includes steps of:

M1: receiving information source data; and

M2: calculating and determining whether a picture of the information source data is a static picture or a dynamic picture, adjusting the refresh rate of the information source data, and generating the first data information with a lower refresh rate if the received picture is the static picture, and generating the first data information with a higher refresh rate if the received picture is the dynamic picture. Thereafter, in step S1, the first data information with the refresh rate dynamically adjusted is processed. Calculating and adjusting according to the actual output can satisfy the optimal setting of dynamic local dimming corresponding to each frame rate, and thus the power consumption can be reduced, and the situation of alternative brightness and darkness of the display panel is improved to a greater extent or even eliminated through the adjustment of the first data driving information and the first backlight driving information. Needless to say, for information source data with different formats, for example, formats with standard refresh rates such as 50 HZ or 60 Hz, the present application can be applicable when the refresh rate is not adjusted, and there will be no display problem.

Specifically, the dynamic local dimming gain table 360 stored in the refresh rate gain adjusting circuit 320 may be exemplified as follows:

| Frame rate | Dynamic local dimming gain value |
|---|---|
| 45 HZ | 107% |
| 47 HZ | 106% |
| 49 HZ | 105% |
| 51 HZ | 104% |
| 53 HZ | 103% |
| 55 HZ | 102% |
| 57 HZ | 101% |
| 59 HZ | 100% |
| 61 HZ | 99% |
| 63 HZ | 98% |
| 65 HZ | 97% |
| 67 HZ | 96% |
| 69 HZ | 95% |

As can be seen from the above table, the dynamic local dimming gain table 360 includes refresh rates (frame rates in the above table) of the first data information and gain values corresponding to the refresh rates, and the greater the refresh rate is, the smaller the gain value is. In step S1, a gain value of the refresh rate of the first data information is mainly found through the dynamic local dimming gain table 360, and then the first backlight driving information is multiplied by the gain value to acquire a second backlight driving information with a gain and the second backlight driving information is output to the backlight driving circuit 330, and the first data driving information is divided by the gain value to acquire the second data driving information with a gain and the second data driving information is output to the data driving circuit 340. It should be noted that, when the refresh rate is smaller than a standard refresh rate of a current display panel, the corresponding preset gain value is greater than or equal to 1; when the refresh rate is greater than the standard refresh rate of the current display panel, the corresponding preset gain value is less than or equal to 1. Assuming that the standard refresh rate 60, when the refresh rate is close to 60, whether it is greater than or less than 60, there will be no change, and the preset gain value is equal to 1.

When the refresh rate changes, on one hand, the brightness of the backlight is adjusted by improving the backlight; on the other hand, the grayscale value in the data drive is correspondingly adjusted to change the deflection angle of the liquid crystal molecules. If the refresh rate is high, the backlight is dimmed, and the grayscale value is adjusted to be high; if the refresh rate is low, the backlight is brightened, and the grayscale value is adjusted to be low. In this way, the brightness of the picture having undergone the local dimming corresponding to different refresh rates tends to be consistent, and thus the contrast ratio of the picture is improved, and the display effect is advanced.

It should be noted that, the limitation of the steps involved in this solution, without affecting the implementation of the specific solution, is not determined to limit the sequence of steps, and the previous steps may be executed first, later, or even simultaneously. Any sequence shall be deemed to fall within the scope of the present application as long as the solution can be implemented.

The technical solution of the present application can be widely used in various display panels, such as Twisted Nematic (TN) display panels, In-Plane Switching (IPS) display panels, Vertical Alignment (VA) display panels and Multi-Domain Vertical Alignment (MVA) display panels.

The above content is a further detailed description of the present application in conjunction with specific, optional embodiments, and it is not to be construed that specific embodiments of the present application are limited to these descriptions. For those of ordinary skill in the art to which the present application belongs, a number of simple derivations or substitutions may be made without departing from the spirit of the present application, all of which shall be deemed to fall within the scope of the present application.

What is claimed is:

1. A driving method for a display panel, comprising steps of:

acquiring a refresh rate of a first data information inputted from the display panel, performing local dimming on the first data information to generate a first backlight driving information and a first data driving information; and adjusting the first backlight driving information and the first data driving information according to the refresh rate of the first data information to correspondingly generate a second backlight driving information to a backlight driving circuit of the display panel, and further generate a second data driving information to a data driving circuit of the display panel;

wherein the greater the refresh rate of the first data information is, the darker a backlight of the backlight driving circuit is made by the second backlight driving information, and further the greater the refresh rate of the first data information is, the greater a grayscale value of the data driving circuit is made by the second data driving information; the smaller the refresh rate is, the brighter the backlight of the backlight driving circuit is made by the second backlight driving information, and further the smaller the refresh rate is, the smaller the grayscale value of the data driving circuit is made by the second data driving information.

2. The driving method according to claim 1, wherein the step of adjusting the first backlight driving information and the first data driving information according to the refresh rate to correspondingly generate a second backlight driving information to a backlight driving circuit of the display panel and further generate a second data driving information to a data driving circuit of the display panel comprises:

finding a gain value of the refresh rate of the first data information through a preset dynamic local dimming backlight gain table; and counting the gain value and the first backlight driving information to generate the second backlight driving information, and then outputting the second backlight driving information to the backlight driving circuit.

3. The driving method according to claim 1, wherein the step of adjusting the first backlight driving information and the first data driving information according to the refresh rate to correspondingly generate a second backlight driving information to a backlight driving circuit of the display panel and further generate a second data driving information to a data driving circuit of the display panel comprises:

finding a gain value of the refresh rate of the first data information through a preset dynamic local dimming data gain table; and outputting the second data driving information with a gain acquired by calculating according to the first data information and the gain value to the data driving circuit.

4. The driving method according to claim 1, wherein the step of adjusting the first backlight driving information and the first data driving information according to the refresh rate to correspondingly generate a second backlight driving information to a backlight driving circuit of the display panel and further generate a second data driving information to a data driving circuit of the display panel comprises:

finding a gain value of the refresh rate of the first data information through a preset dynamic local dimming gain table; and outputting the second backlight driving information with a gain acquired by multiplying the first backlight driving information by the gain value to the backlight driving circuit, and outputting the second data driving information with a gain acquired by dividing the first data driving information by the gain value to the data driving circuit.

5. The driving method according to claim 4, wherein the preset dynamic local dimming gain table comprises a plurality of refresh rates of the first data information and gain values corresponding to the plurality of refresh rates of the first data information in a one-to-one manner; the greater the refresh rate is, the smaller the corresponding gain value is; when the refresh rate is smaller than a standard refresh rate of a current display panel, the corresponding preset gain value is greater than or equal to 1, and when the refresh rate is greater than the standard refresh rate of the current display panel, the corresponding preset gain value is smaller than or equal to 1.

6. The driving method according to claim 1, wherein in the step of acquiring a refresh rate of a first data information inputted from the display panel, performing local dimming on the first data information to generate a first backlight driving information and a first data driving information, the refresh rate of the first data information is acquired by storing and calculating the number of pictures of the first data information inputted in one second.

7. The driving method according to claim 6, further comprising, before the step of acquiring a refresh rate of a first data information inputted from the display panel, performing local dimming on the first data information to generate a first backlight driving information and a first data driving information:

receiving information source data; and calculating and determining whether a picture of the information source data is a static picture or a dynamic picture, adjusting the refresh rate of the information source data, and generating the first data information with a lower refresh rate if the received picture is the static picture, and generating the first data information with a higher refresh rate if the received picture is the dynamic picture.

8. The driving method according to claim 1, wherein the step of adjusting the first backlight driving information and the first data driving information according to the refresh rate to correspondingly generate a second backlight driving information to a backlight driving circuit of the display panel and further generate a second data driving information to a data driving circuit of the display panel comprises:

calculating the second backlight driving information with a gain and the second data driving information with a gain by fitting a function, and respectively outputting the second backlight driving information and the second data driving information to the backlight driving circuit and the data driving circuit.

9. The driving method according to claim 1, wherein the refresh rate of the first data information is 60 HZ.

10. A driver chip for a display panel, comprising:

a local dimming circuit configured for receiving a first data information inputted by the display panel for local dimming and outputting a first backlight driving information and a first data driving information;

a refresh rate gain adjusting circuit configured for receiving the first data information inputted by the display panel, acquiring a refresh rate of the first data information, and adjusting the first backlight driving information according to the refresh rate to form and output a second backlight driving information, and adjusting the first data driving information according to the refresh rate to form and output a second data driving information;

a backlight driving circuit connected to the refresh rate gain adjusting circuit and configured for receiving the second backlight driving information and driving a backlight module of the display panel to display; and a data driving circuit connected to the refresh rate gain adjusting circuit and configured for receiving the second data driving information and driving the display panel to display;

wherein the greater the refresh rate of the first data information is, the darker a backlight of the backlight driving circuit is made by the second backlight driving information, and further the greater the refresh rate of the first data information is, the greater a grayscale value of the data driving circuit is made by the second data driving information; the smaller the refresh rate is, the brighter the backlight of the backlight driving circuit is made by the second backlight driving information, and further the smaller the refresh rate is, the smaller the grayscale value of the data driving circuit is made by the second data driving information.

11. The driver chip according to claim 10, wherein the refresh rate gain adjusting circuit comprises:

a refresh rate gain value generating circuit with stored therein a preset dynamic local dimming gain table comprising a plurality of refresh rates of the first data information and gain values corresponding to the plurality of refresh rates of the first data information in a one-to-one manner; and a gain calculating circuit;

wherein the refresh rate gain value generating circuit finds a gain value of the refresh rate of the first data information through the preset dynamic local dimming gain table, and the gain calculating circuit calculates according to the first backlight driving information, the first data driving information and the corresponding gain value to acquire the second backlight driving information and the second data driving information and respectively outputs the second backlight driving information and the second data driving information to the backlight driving circuit and the data driving circuit.

12. The driver chip according to claim 11, wherein the gain calculating circuit comprises a multiplication calculator and a division calculator; the multiplication calculator multiplies the first backlight driving information by the gain value to acquire the second backlight driving information with a gain and outputs the second backlight driving information to the backlight driving circuit; the division calculator divides the first data driving information by the gain value to acquire the second data driving information with a gain and outputs the second data driving information to the data driving circuit.

13. The driver chip according to claim 11, wherein the first data information is acquired by adjusting with a refresh rate adjusting circuit coupled to the refresh rate gain value generating circuit and the local dimming circuit.

14. The driver chip according to claim 13, wherein the refresh rate adjusting circuit calculates and determines whether a picture of the information source data is a static picture or a dynamic picture, adjusts the refresh rate of the information source data, and generates the first data information with a lower refresh rate if the received picture is the static picture, and generates the first data information with a higher refresh rate if the received picture is the dynamic picture.

15. The driver chip according to claim 11, wherein the dynamic local dimming gain table comprises refresh rates of the first data information and gain values corresponding to the refresh rates, and the greater the refresh rate, the smaller the gain value.

16. The driver chip according to claim 15, wherein when the refresh rate is smaller than a standard refresh rate of a current display panel, the corresponding preset gain value is greater than or equal to 1, and when the refresh rate is greater than the standard refresh rate of the current display panel, the corresponding preset gain value is smaller than or equal to 1.

17. A display device, comprising a display panel, a backlight module and a driver chip, wherein the driver chip drives the backlight module and the display panel for image display, and the driver chip comprises:

a local dimming circuit configured for receiving a first data information inputted by the display panel for local dimming and outputting a first backlight driving information and a first data driving information;

a refresh rate gain adjusting circuit configured for receiving the first data information inputted by the display panel, acquiring a refresh rate of the first data information, and adjusting the first backlight driving information according to the refresh rate to form and output a second backlight driving information, and adjusting the first data driving information according to the refresh rate to form and output a second data driving information;

a backlight driving circuit connected to the refresh rate gain adjusting circuit and configured for receiving the second backlight driving information and driving a backlight module of the display panel to display; and a data driving circuit connected to the refresh rate gain adjusting circuit and configured for receiving the second data driving information and driving the display panel to display;

wherein the greater the refresh rate of the first data information is, the darker a backlight of the backlight driving circuit is made by the second backlight driving information, and further the greater the refresh rate of the first data information is, the greater a grayscale value of the data driving circuit is made by the second data driving information; the smaller the refresh rate is, the brighter the backlight of the backlight driving circuit is made by the second backlight driving information, and further the smaller the refresh rate is, the smaller the grayscale value of the data driving circuit is made by the second data driving information.

18. The display device according to claim 17, wherein the first data information is acquired by adjusting with a refresh rate adjusting circuit coupled to the refresh rate gain value generating circuit and the local dimming circuit;

the refresh rate adjusting circuit calculates and determines whether a picture of the information source data is a static picture or a dynamic picture, adjusts the refresh rate of the information source data, and generates the first data information with a lower refresh rate if the received picture is the static picture, and generates the first data information with a higher refresh rate if the received picture is the dynamic picture.

19. The display device according to claim 18, wherein the refresh rate gain adjusting circuit comprises:

the refresh rate gain value generating circuit with stored therein a preset dynamic local dimming gain table comprising a plurality of refresh rates of the first data information and gain values corresponding to the plurality of refresh rates of the first data information in a one-to-one manner; and a gain calculating circuit comprising a multiplication calculator and a division calculator;

wherein the refresh rate gain value generating circuit finds a gain value of the refresh rate of the first data information through the preset dynamic local dimming gain table, and the multiplication calculator multiplies the first backlight driving information by the gain value to acquire the second backlight driving information with a gain and outputs the second backlight driving information to the backlight driving circuit, and the division calculator divides the first data driving information by the gain value to acquire the second data driving information with a gain and outputs the second data driving information to the data driving circuit.

* * * * *